US007930851B1

(12) United States Patent
Woolsey

(10) Patent No.: US 7,930,851 B1
(45) Date of Patent: Apr. 26, 2011

(54) FIREARM STRAP TENSIONER

(76) Inventor: Wayne Woolsey, Fayetteville, AR (US)

( * ) Notice: Subject to any disclaimer, the term of this patent is extended or adjusted under 35 U.S.C. 154(b) by 0 days.

(21) Appl. No.: 12/924,222

(22) Filed: Sep. 23, 2010

Related U.S. Application Data

(63) Continuation of application No. 12/378,546, filed on Feb. 17, 2009, now abandoned, which is a continuation of application No. 11/702,438, filed on Feb. 5, 2007, now abandoned, which is a continuation-in-part of application No. 11/174,053, filed on Jul. 1, 2005, now abandoned.

(51) Int. Cl.
*F41C 23/02* (2006.01)

(52) U.S. Cl. ..... 42/85; 224/150

(58) Field of Classification Search ..... 42/85, 90, 42/106; 224/150; 119/796, 797
See application file for complete search history.

(56) References Cited

U.S. PATENT DOCUMENTS

| | | | | | |
|---|---|---|---|---|---|
| 1,051,914 | A * | 2/1913 | Prochnow | 42/85 |
| 1,069,623 | A * | 8/1913 | Lutkens | 42/85 |
| 1,115,737 | A * | 11/1914 | Prochnow | 42/85 |
| 2,614,355 | A * | 10/1952 | Rogers et al. | 42/85 |
| 3,319,852 | A | 5/1967 | Perkins | 224/1 |
| 3,653,564 | A | 4/1972 | Carter | 224/1 |
| 4,311,263 | A | 1/1982 | Bianchi | 224/150 |
| 4,361,258 | A | 11/1982 | Clark | 224/150 |
| 5,009,022 | A | 4/1991 | McCoy | 42/94 |
| 5,802,756 | A | 9/1998 | Hightower | 42/85 |
| 5,911,216 | A | 6/1999 | Killian | 124/86 |
| 6,003,472 | A | 12/1999 | Matt et al. | 119/796 |
| 6,276,071 | B1 | 8/2001 | Khachatoorian | 33/767 |
| 2004/0083637 | A1 * | 5/2004 | Sands | 42/85 |

* cited by examiner

*Primary Examiner* — Michael Carone
*Assistant Examiner* — Gabriel J Klein
(74) *Attorney, Agent, or Firm* — Keisling & Pieper PLC; Stephen D. Schrantz

(57) ABSTRACT

A strap tensioning apparatus consisting of a strap tensioner attached to a firearm, a spring loaded spool contained within the strap tensioner, the strap having one end releasable attached to the spool, the strap exiting the spool, the other end of the strap attached to the firearm. The spool adapted to be adjustable between three different modes: a lock mode, a release mode, and a free spool mode. The strap tensioner allows a user to easily and safely adjust the tension of the strap to increase comfort, mobility, and safety.

4 Claims, 10 Drawing Sheets

FIREARM STRAP TENSIONER

CROSS-REFERENCE TO RELATED APPLICATIONS

This application claims priority to and is a continuation of U.S. application Ser. No. 12/378,546 filed Feb. 17, 2009, now abandoned which is a continuation U.S. application Ser. No. 11/702,438, filed Feb. 5, 2007, now abandoned which is a continuation in part of U.S. application Ser. No. 11/174,053 filed Jul. 1, 2005 now abandoned.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

This invention relates to a strap tensioner for a firearm adapted to adjust a strap attached to the firearm to different lengths. The strap tensioner provides a housing attached to the firearm that contains a strap that is also attached to the firearm. The strap tensioner contains a spool upon which the strap is wound. With the press of the lever, a user is able to vary the amount of strap outside of the housing. Known art may be found in U.S. Class 224, Subclasses 150, 162 and 270 and U.S. Class 24, Subclass 68R and other relevant areas.

2. Description of the Known Art

As will be appreciated by those skilled in the art, firearm transportation on the body of a user in the field can be dangerous as well as burdensome and tiresome. For literally centuries, firearm users have employed straps in an attempt to address these issues.

Throughout history, users of firearm straps have faced many difficulties with the known firearm straps, also known as gun slings. For example, the straps are not readily adjustable. A user is required to adjust the strap to fit any number of various types of firearms of all dimensions, shapes, and sizes. The known firearm straps use buckles to vary the tension of the strap on a user. The straps, if not fitted correctly, tend to slide on a user and allow the firearm to move from a secured position. If a strap needs to be tightened or loosened, a user is required to stop all activities simply to adjust the amount of strap through the buckle. The amount of strap needed varies depending on the type of weather. If it is hot outside, a user wears less clothing and needs to tighten the strap in order to compensate for wearing less clothing. If it is cold outside, a user wears more clothing and needs to loosen the strap. A user also wants to adjust the tension of the strap according to a user's activity, whether it be running, climbing, or walking.

Furthermore, the known art does not allow a user to secure a firearm so that a user can quickly and easily raise the firearm to a firing position in order to take a quick shot.

The known firearm straps also place users into many dangerous situations. By not properly securing the firearm to the user, a user could accidentally point the firearm in the direction of himself or others. The firearm could also bounce around while the user is transporting the firearm. If the firearm is not properly secured, a user could drop the firearm causing the firearm to accidentally fire. The known strap systems also allow excess strap to hang loosely from the firearm. This excess strap interferes with a user's movements. The excess strap could snag on a user, brush, and/or other objects.

The known strap systems do not provide a user with a means to lift the firearm to elevated heights such as a tree stand. The known method of lifting a firearm to a tree stand involves pointing a firearm in the direction of the user or others as a user raises the firearm.

The known art has addressed some issues with firearm transportation by straps.

U.S. Pat. No. 1,069,623 issued to Lutkens on Aug. 5, 1913 discloses a device whereby a firearm strap may be withdrawn into the firearm when not in use, and has for its objects to provide a device for withdrawing the said strap into the firearm stock, entirely out of the way and for adjusting the tension of the strap when it is in use.

U.S. Pat. No. 1,115,737 issued to Prochnow on Nov. 3, 1914 provides means for locking the winding spool with the strap extended to any desired length.

U.S. Pat. No. 5,911,216 issued to Killian on Jun. 15, 1999 discloses an archer's bow which includes a riser between upper and lower limbs, and secured to limbs with bolt fasteners. A housing contains a spool with flexible webbing wound thereon. A leg extends at an acute angle to the housing and includes an aperture for securement to one of the bolt fasteners. Webbing extends through an opening in the housing and is wound to one side of the riser so as to be maintained clear of the sight window. The webbing automatically retracts when worn by a user to adjust tension in the webbing as a bow is carried while climbing or running. Further, the webbing automatically retracts immediately upon dismount and clears the sight window before even a quick shot can be taken.

U.S. Pat. No. 5,009,022 issued to McCoy on Apr. 23, 1991 discloses a gun safety assembly including a hand gun, a reel bearing an elongated cord connected thereto and a spring connected to the reel for biasing the cord toward and around the reel. The device also includes a ring on the gun butt and a snap ring on the free end of the cord releasably connecting the gun and cord, and a loop on the reel releasably connecting it to a gun belt.

U.S. Pat. No. 5,802,756 issued to Hightower on Sep. 8, 1998, discloses a firearm sling constructed with an elongated pad having at one end a thumb loop.

U.S. Pat. No. 3,319,852 issued to Perkins on May 16, 1967 discloses a conventional firearm sling featuring thistle-cloth fasteners sold under the trademark "Velcro" located at the face of the strap.

U.S. Pat. No. 3,653,564 issued to Carter on Apr. 4, 1972 discloses a lower end cup for supporting a muzzle with a sling passing around the body of a shoe.

U.S. Pat. No. 4,311,263 issued to Bianchi on Jan. 19, 1982 discloses a firearm sling with a thumb support.

U.S. Pat. No. 4,361,258 issued to Clark on Nov. 30, 1982 discloses a locking ring for adjustment on a general carrying strap applicable to various objects.

While some devices have attempted to allow a user to more easily adjust a strap, none of these devices allow the user to adjust the strap with a touch of a toggle. Furthermore, these devices do not wind the excess strap that is not used by the strap tensioner. These devices do not store the excess strap internally thus preventing the strap from snagging on obstacles. These devices are not retrofittable so that the device can be placed on any type of firearm after the firearm has been purchased.

The straps disclosed in the known art are not readily adjustable to enable the user to easily adjust the strap for a variety of different weathers or motions. Thus, the present invention directs itself to an improved firearm holding apparatus that is safer to use and that functions more efficiently by allowing a user to easily adjust the tension of the strap. Thus, a perceived need exists in the art for an improved strap tensioner for firearms. It is, therefore, an object of the present invention to eliminate the problems inherent with existing known strap tensioners for holding firearms.

SUMMARY OF THE INVENTION

The present invention involves a strap tensioner that is adapted to be readily adjusted to properly secure a firearm. The strap tensioner includes a strap having two ends. One end of the strap attaches to a firearm. The other end of the strap attaches to a spool. The spool is rotatably attached to a housing or a frame. The housing or frame is coupled to the firearm.

The spool is operatively engaged with a retraction device. The retraction device is a spring attached to the spool that biases the spool. A toothed gear with a pivotable control lever locks the spool in place so that the strap cannot be biased. When the release toggle is pressed, a control lever disengages from a toothed gear to bias the spool so that the strap can be selectively tensioned. If a user pulls on the strap while the control lever is disengaged from the toothed gear, the strap will unwind from the spool thus increasing the amount of strap outside of the housing. If a user does not pull on the strap, the strap will retract into the housing and onto the spool.

The spool stores the excess strap that is not needed by a user. By winding the excess strap onto the spool, the strap tensioner stores the excess strap in the housing. If extra strap is needed by the user, the user can remove the extra strap from the housing to increase the amount of strap used to support the firearm.

A spring enables the spool to selectively tension the strap. A user can disengage the spring from the spool. By disengaging the spring from the spool, the user adjusts the spool into a free spool mode. The free spool mode allows a user to both install the strap onto the spool and remove the strap from the spool. A user can then reengage the spring in order to adjust the spool out of the free spool mode.

Thus, a primary object of the present invention is to provide a strap tensioner that is easily adjustable in length in order to accommodate various types of firearms of all dimensions, shapes, and sizes.

Yet another object of the present invention is to create a strap tensioner that will not slide once positioned on the shoulder or around the neck making for a safer use.

Another object of the present inventions is to internally stow the excess strap in a housing.

Another object of the present invention is to create a safer strap tensioner, in particular, during the resting position leaving the hands free for other important purposes.

Another object of the present invention is to create a strap tensioner which when in the resting position, the firearm is pointed away from the body, and at the same time, enables the firearm to be easily and quickly raised to the shooting position.

Another object of the present invention is to provide a strap tensioner for a firearm that is self-storing and automatic in its operation so as to avoid distraction to a user's concentration.

Another object of this invention is to provide a carry system of the above-described type which automatically accommodates a wide range of user's movements, such as climbing and running, without requiring attention or direct intervention from the user.

Another object of this invention is provide a user with a simpler means of adjusting a firearm strap during different climates so that a user can adjust the strap according to the amount of clothing a user is wearing.

Another object of this invention is to provide a user with a safer method of attaching a pull-rope to the firearm so that the barrel of the firearm will be pointed at the ground while the user is raising the firearm to greater heights such as up to a tree stand.

Another object of this invention is to provide a user with means to easily tighten the strap so that the firearm will be flush against the user in order to avoid noise made by movement of the firearm and to prevent the firearm from bumping into obstacles.

Another object of this invention is to provide a retrofittable device that can be installed on a firearm after purchase. The device can also be removed from one firearm and installed on a different firearm.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
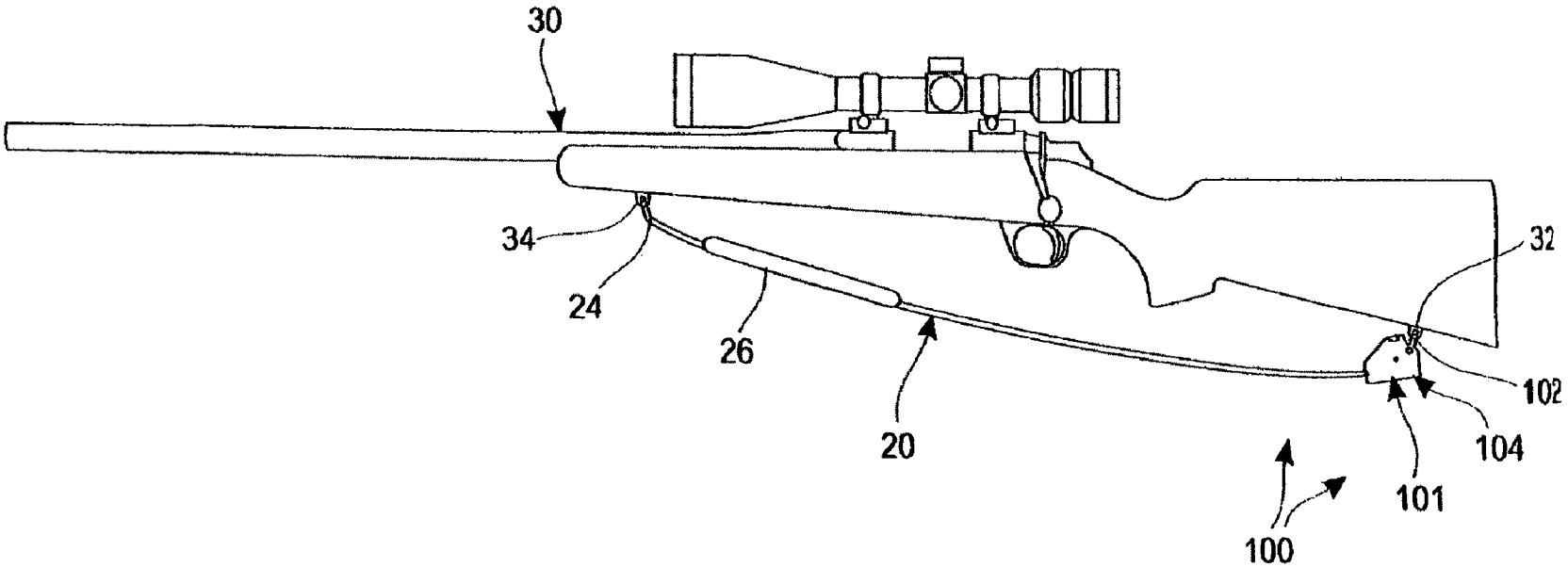
FIG. 1 is an environmental view showing an exemplary embodiment in accordance with the invention herein.

Referring more specifically to the drawings, the strap tensioner is generally indicated by reference numeral 100. As can be seen in FIG. 1, the strap tensioner 100 attaches to the firearm 30. The strap tensioner 100 secures one end of the gun sling or strap 20 to the firearm 30 at stud 32. The opposite end of strap 20 is secured conventionally to firearm 30 at stud 34. The strap tensioner 100 may be located proximate the butt or the forearm or there between.

The strap tensioner 100 mounts on the exterior of the firearm 30. The strap tensioner 100 is retrofittable so that it can be switched to any number or type of firearms. The strap tensioner 100 has a coupling 102 that attaches to the butt stud 32 of firearm 30. One strap end 22 attaches to the spool 124. The other strap end 24 attaches to the stock stud 34 of the firearm 30. A cushion 26 is placed on the strap 20 for added comfort. The spool 124 is attached to frame 101. In one particular embodiment, the frame 101 is a housing 104 in which spool 124 is stored. As is known in the art, the frame can be any structure including a housing. The spool has a retraction device that allows the spool to automatically wind the strap. In one embodiment, the retraction device is a spring releasable attached to the spool. As is known in the art, the retraction device can take other forms.

FIG. 1 shows an environmental view of an exemplary embodiment of strap tensioner 100 shown attached to a firearm 30, including a housing 104 comprised of a front surface 106, a rear surface 108, a front side surface 110, a rear side surface 112, a top surface 114, and a bottom surface 116; a spool 124 upon which the excess strap 20, is wound; a coupling 102 adapted to attach the strap tensioner to a firearm; a release toggle 118; and a strap 20. One end of the strap 24 is attached to the stock stud 34 of the firearm 30. A coupling 102 attaches the housing 104 to the butt of the firearm 30. A cushion 302 is attached to the strap 20 to provide added comfort to a user.

In a preferred embodiment, the housing 104 is a parallelepiped structure. The housing 104 is enclosed in a rubber casing. Because of the rubber casing, a user can sneak along and not have to worry about the strap tensioner 100 making unnecessary noises or reflections off of the strap tensioner 100 that would scare game. In order to avoid being seen by game, the strap tensioner 100 can be made to blend into the environment. More specifically, the housing 104 can be camouflage or black so that game will be less likely to see the strap tensioner.

Figure 2:
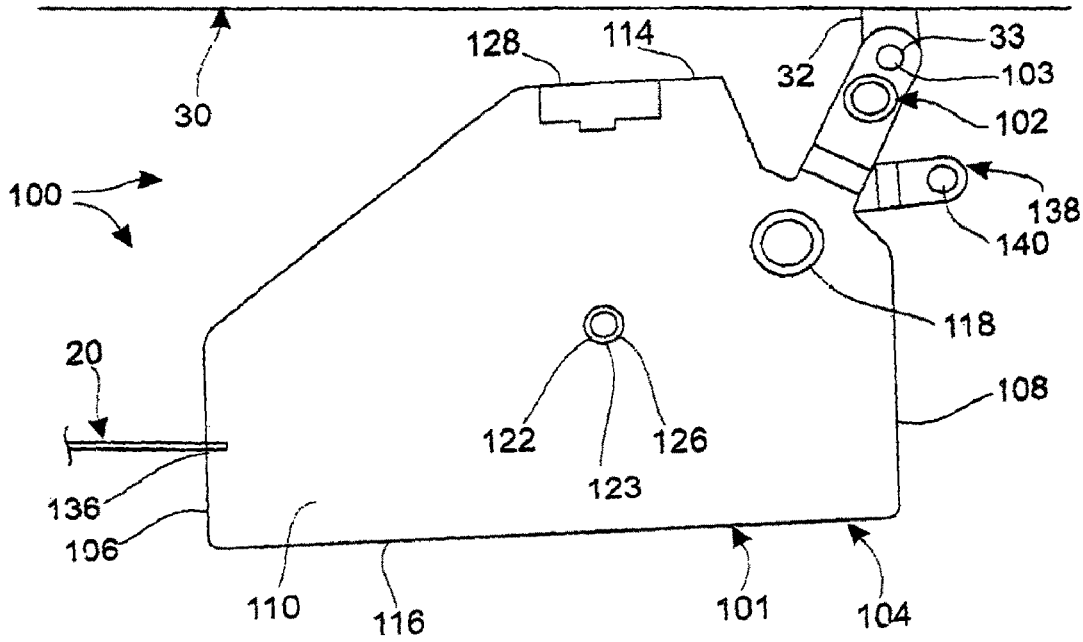
FIG. 2 is a front elevational view thereof.

As can be seen in FIG. 2, the strap tensioner 100 has a coupling 102 adapted to attach the strap tensioner 100 to the butt stud 32 of the firearm 30. The coupling 102 has a stud pin aperture 103 in which a stud pin 33 can be inserted. By placing the stud pin 33 into the stud pin aperture 103, a user attaches the strap tensioner 100 to the firearm 30. As is known in the art, the coupling 102 could attach the strap tensioner 100 to other parts of the firearm 30 and the strap tensioner 100 could be attached to the firearm 30 by other means.

The strap tensioner 100 has a release toggle 118 recessed within the housing 104. The release toggle 118 adjusts the spool 124 into different modes. Pressing the release toggle affects the placement of the control lever seen in FIG. 8. The position of the control lever determines the mode of the spool. The modes include a lock mode, a release mode, and a free spool mode. The three modes will be discussed in greater detail below. The release toggle 118 is recessed within the housing 104 as a safety measure in order to prevent accidental pressing of the release toggle 118 causing the amount of strap 20 outside of the housing 104 to vary. In other embodiments, the release toggle 118 is not required to be recessed within the housing 104.

As can be seen in FIG. 2, the housing 100 has a front side surface 110 that comprises a spool adjustment aperture 126. The spool adjustment aperture 126 provides access to the catch 122 found inside the housing 104. The catch 122 is adapted to accept an Allen wrench. A user inserts an Allen wrench into the spool adjustment aperture 126 in order to adjust the spool 124. A user can adjust the catch 122 in either direction. The user rotates the catch 122 in one direction in order to adjust the spool 124 into a free spool mode. A user can rotate the catch 122 in the opposite direction in order to reengage the spring and adjust the spool 124 out of the free spool mode. The primary function of the catch 122 is to allow a user to adjust the spool 124 into and out of the free spool mode. In order to install and remove the strap 20, the spool 124 must be adjusted to the free spool mode. As is known in the art, other adjustment means besides an Allen wrench can be used to engage or disengage the catch.

Continuing to refer to FIG. 2, the housing 104 also has a housing top 128. The housing top 128 is hinged to the housing 104. In a preferred embodiment, the housing top 128 is a flip top that flips toward the hinges 130 and 132. The housing top 128 covers the strap installation aperture 134. The housing top 128 prevents debris and other objects from entering the strap installation aperture 134. A user installs and removes the strap 20 from the spool 124 through the strap installation aperture 170.

To install the strap 20 onto the spool 124, a user adjusts the spool 124 into the free spool mode by pressing the release toggle 118 and adjusting the catch 122. To adjust the catch 122, the user inserts an Allen wrench into the spool adjustment aperture 126 and rotates the Allen wrench. Next, a user opens the housing top 128 to reveal the strap installation aperture 134. A user then inserts an end of the strap 22 into the spool slit 125 found on the spool 124. By inserting the strap 20 into the spool slit 125, a user attaches the strap 20 so that the strap 20 cannot be completely unwound from the spool 124. A user will then need to manipulate the other end of the strap 24 through the strap tension aperture 136 and attach the strap 24 to a stock stud 34. The user then rotates the Allen wrench in the opposite direction in order to lock the strap 20 into the spool slit 125. By rotating the Allen wrench in the opposite direction, the user reengages the catch 122. Now, the strap 20 has been connected to the spool 124 and will not be released until the user places the spool 124 back into free spool mode and removes the end of the strap 20 from the spool slit 125. In another embodiment, the strap end 22 attached to the spool 124 can have a slit so that a pin or some other obstruction can be placed into the strap end 22 after the strap end 22 has been inserted through the spool slit. While engaged, the pin or some other obstruction would prevent the strap 20 from being completely removed from the spool 124.

Furthermore, FIG. 2 shows the strap tension aperture 136. The strap 20 enters and leaves the housing 104 through the strap tension aperture 136. After entering the strap tension aperture 136, the strap 20 winds onto the spool 124. The excess strap 20 that leaves the strap tension aperture 136 unwinds from the spool 124 and exits the strap tension aperture 136.

The strap tensioner 100 also has a lifting arm 138 as can be seen in FIG. 2. The lifting arm 138 is attached to the housing 104. The lifting arm 138 can be attached to a rope so that a user can lift the firearm 30 to higher elevations. A rope or other form of webbing is attached to the lifting arm 138 through the arm aperture 140. The lifting arm 138 is adapted to support the entire weight of the firearm 30. By attaching a webbing to the lifting arm 138, a user can lift the firearm 30 to higher elevations while pointing the firearm 30 in an oriented direction. In particular, the firearm is pointed toward the ground away from the user. This added safety feature prevents the firearm 30 from firing at the user while the user is lifting the firearm 30 to a higher elevation such as a tree stand.

Figure 3:
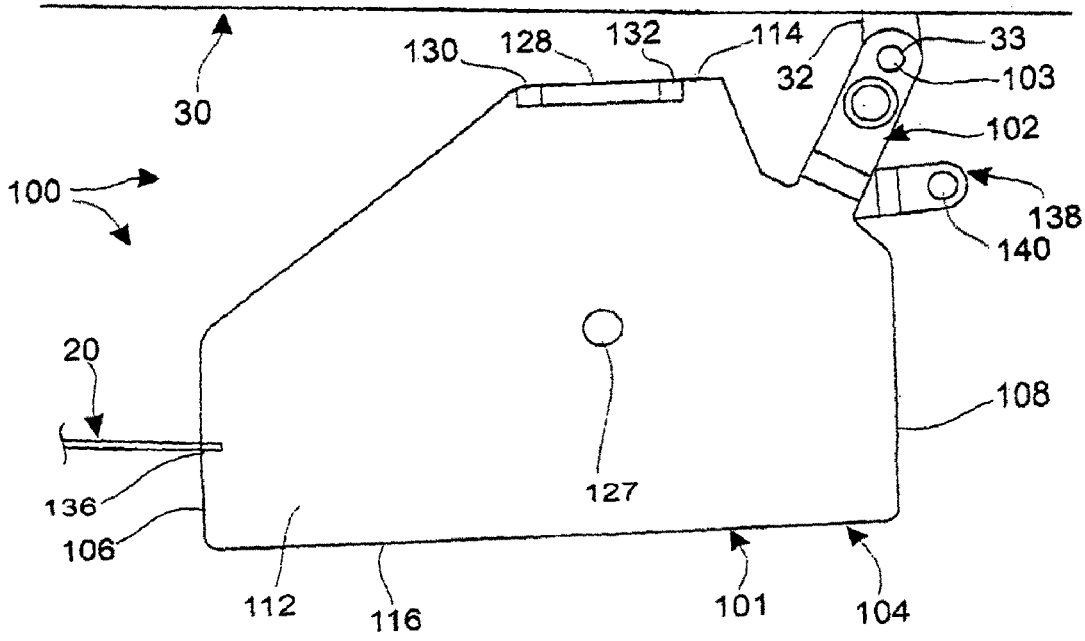
FIG. 3 is a rear elevational view thereof.

As can be seen in FIG. 3, the rear side surface 112 is different from the front side surface 106 shown in FIG. 2. The spool housing top 128 is attached to the housing 104 so that the housing top 128 can be opened. When the housing top 128 is opened, the spool installation aperture 170 is accessible. FIG. 3 better shows hinges 130 and 132 that attach the housing top 128 to the housing 104. An axle connector 127 is attached to the rear side surface 112 of the housing 104. The axle connector 127 attaches the axle to the housing so that the axle will not allow the spool to contact the housing 104. The axle connector 127 will allow both the axle 123 and the spool 124 to rotate inside of the housing 104. The housing 104 does not impede with the rotation of the spool 124.

Figure 4:
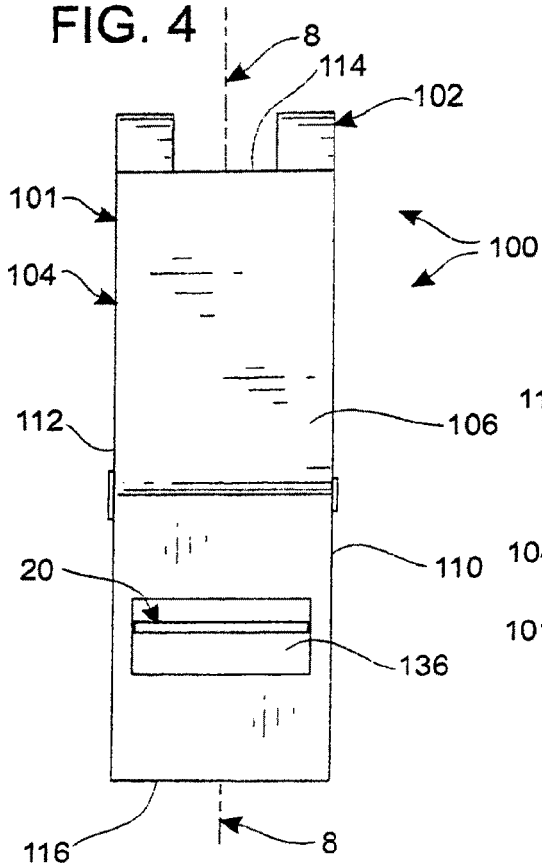
FIG. 4 is a front plan view thereof.

As can be seen in FIG. 4, the strap tensioner 100 has a front surface 106 that includes the strap tension aperture 136. The strap tension aperture 136 provides a means for the strap to enter and exit the housing 104. Furthermore, the strap tension aperture 136 provides a passageway from outside of the housing 104 to the spool 124. The spool 124 is spring loaded so that as the strap 20 enters the housing 104, the strap 20 is wound onto the spool 124. Any strap 20 that exits the housing 104 during the release mode is first unwound from the spool 124.

Figure 5:
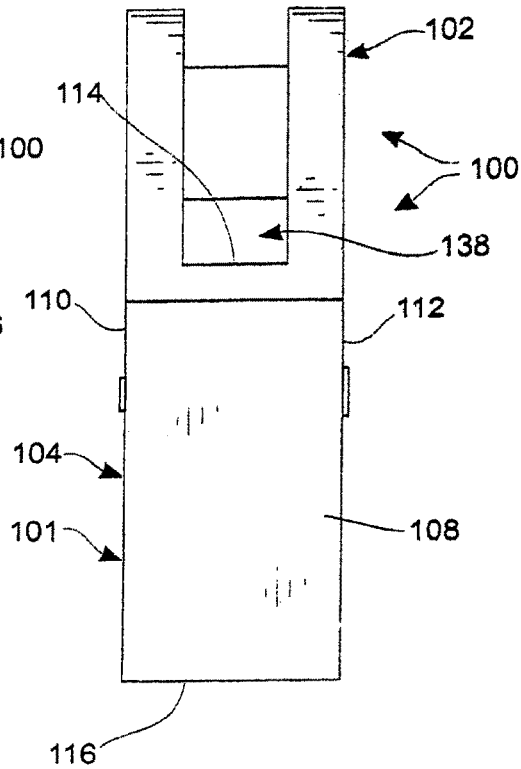
FIG. 5 is a rear plan view thereof.

The strap tensioner 100 has a rear surface 108 as can be seen in FIG. 5. The lifting arm 138 is attached to the rear surface 108 of the housing 104. The coupling 102 is positioned on the strap tensioner 100 so that the strap tensioner 100 can be securely attached to the firearm 30.

Figure 6:
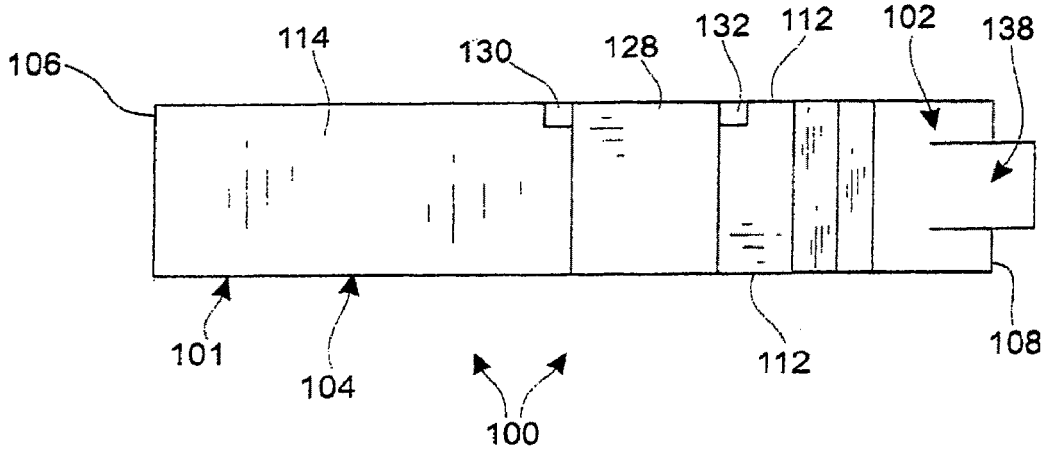
FIG. 6 is a top plan view thereof.

Referring to FIG. 6, the strap tensioner 100 has a top surface 114 that includes the strap installation aperture 134. In order to access the strap installation aperture 134, the housing top 128 must first be opened. The strap installation aperture 134 also provides the strap a passageway from outside of the housing 104 to the spool 124.

In order to install the strap, a user will adjust the spool into a free spool mode. The user can then manipulate the strap 20 through the strap installation aperture 134. A user can attach strap 20 to the spool 124 by attaching an end of the strap 20 through a spool slit 125. Other attachment means known in the art can also be used to releasably attach strap 20 to the spool 124.

A user can also remove the strap 20 from the spool 124 through the strap installation aperture 134. Again, the user must adjust the spool 124 into a free spool mode. A user can then detach the strap 20 from the spool slit 125 and remove the strap 20 from the spool 124 through the strap installation aperture 134.

Figure 7:
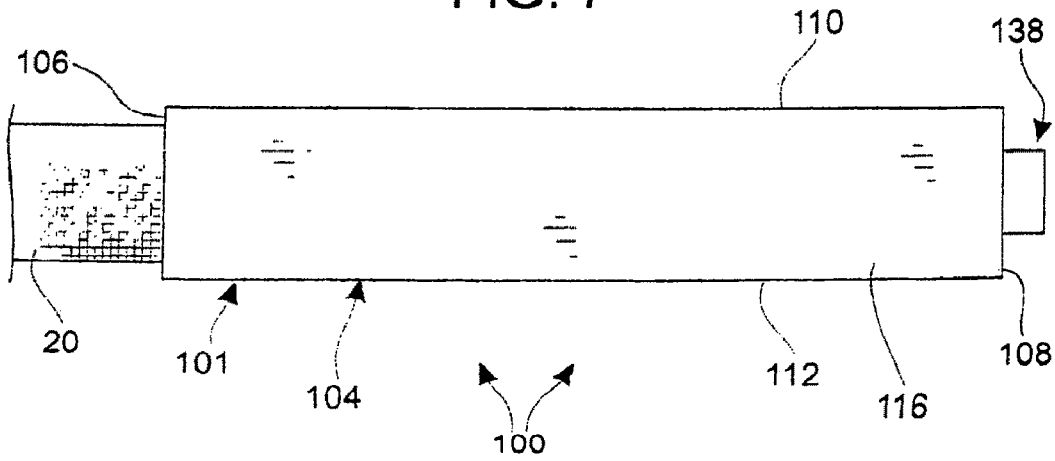
FIG. 7 a bottom plan view thereof.

As can be seen in FIG. 7, the strap tensioner has a bottom surface 116. The lifting arm 138 is an extension of the housing 102. By extending the lifting arm 138 from the housing 104, the lifting arm 138 will not interfere with the strap 20 or the spool 124.

Figure 8:
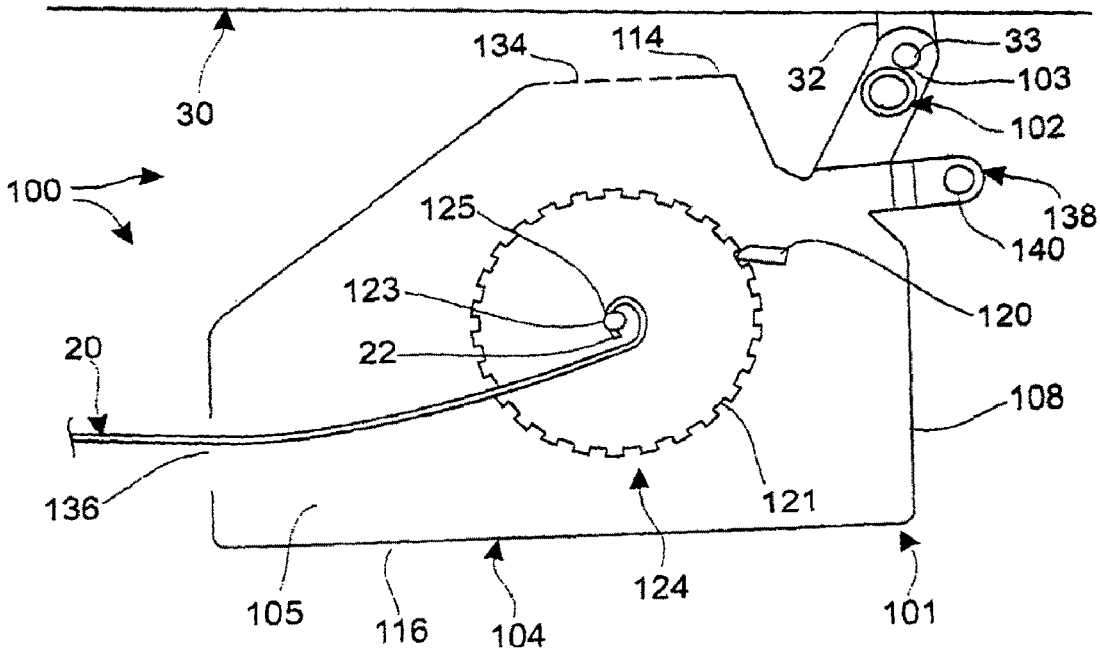
FIG. 8 is a sectional view taken along line 8-8 of FIG. 4 thereof, with portions omitted for clarity.

FIG. 8 shows the inner workings of the strap tensioner 100. The strap 20 enters the housing 104 through the strap installation aperture 180. The housing interior 105 provides a pathway for the strap 20 to access the spool 124. The strap 20 is wound onto a spool 124 contained within the housing 104. The spool 124 is mounted upon an axle 123. The axle 123 is mounted to the housing as can be seen in FIGS. 2, 3, and 8. The axle 123 is adapted to allow the spool 124 to rotate without contacting the inside of the housing 104. The axle 123 is adapted to be operatively engaged by the spring. The catch 122 allows the spring to operatively engage the axle 123. By disengaging from the spring, the catch 122 allows the spool 124 to freely rotate. By engaging with the spring, the catch 122 causes the spool 124 to be spring loaded.

Because the spool 124 is spring loaded, the strap 20 will retract into the housing 104 and wind onto the spool 124 when the control lever 120 is not in place. The control lever 120 is adjusted to different positions as the spool is changed to different modes. In the lock mode, the control lever 120 is engaged with the toothed gear 121 of the spool 124. While engaged, the control lever 120 prevents the strap 20 from being both wound onto the spool 124 and from being unwound from the spool 124. The toothed gear and control lever can be substituted with any variation of a ratcheting or tensioning system.

When the release toggle 118 is pressed, the spool 124 is adjusted into the release mode. The control lever 120 is no longer engaged with the toothed gear 121 of the spool 124. Because the control lever 120 is no longer engaged with the toothed gear 121, the amount of strap 20 outside of the housing 104 can vary. By pulling on the strap 20 while the spool 124 is in release mode, a user can increase the amount of strap 20 outside of the housing 104. The user unwinds the needed amount of strap 20 from the spool 124. When the user has selectively tensioned the strap 20, the user can press the release toggle 118 again to lock the strap 20 in place. By pressing the release toggle 118 again, the user adjusts the spool into lock mode. The control lever 120 reengages the toothed gear 121. The control lever 120 prevents the spool 124 from spinning thus it prevents the strap 20 from being wound onto the spool or unwound from the spool 124. The strap tensioner 100 is designed so that the strap 20 will not be released from the spool 124 while the spool 124 is in release mode.

If a user does not pull the strap 20 while the spool 124 is in release mode, the spring loaded spool 124 will retract the strap 20 into the housing 104. As the strap 20 retracts into the housing 104, the strap 20 is wound onto the spool 124. By winding the strap 20 onto the spool 124 when the release toggle 118 is pressed, the strap tensioner 100 keeps the firearm 30 taut against a user. A user can press the release toggle 118 again in order to place the spool 124 into lock mode. In lock mode, the control lever 120 engages the toothed gear 121 preventing the strap 20 from retracting onto the spool 124.

Lastly, the spool 124 can be adjusted to a free spool mode. A user adjusts the spool 124 into free spool mode by placing an Allen wrench into the spool adjustment aperture 126. A user turns the Allen wrench a number of times to disengage the catch 122 from the spring. The user can then press the release toggle 118 so that the control lever 120 will be disengaged from the toothed gear 121. In the free spool mode, a user can remove the strap 20 from the spool slit 125 in the spool 130. By removing the strap 20 from the spool slit, a user can completely unwind the strap 20 from the spool 124.

In order to install the strap 20 onto the spool 124, the user places the spool 124 into the free spool mode. A user then inserts one end of the strap 22 into the spool slit 125. A user must then manipulate the other end of the strap 24 through the strap tension aperture 136. The user then turns an Allen wrench head inside of the spool adjustment aperture to reengage the catch to adjust the spool out of the free spool mode.

Figure 9:
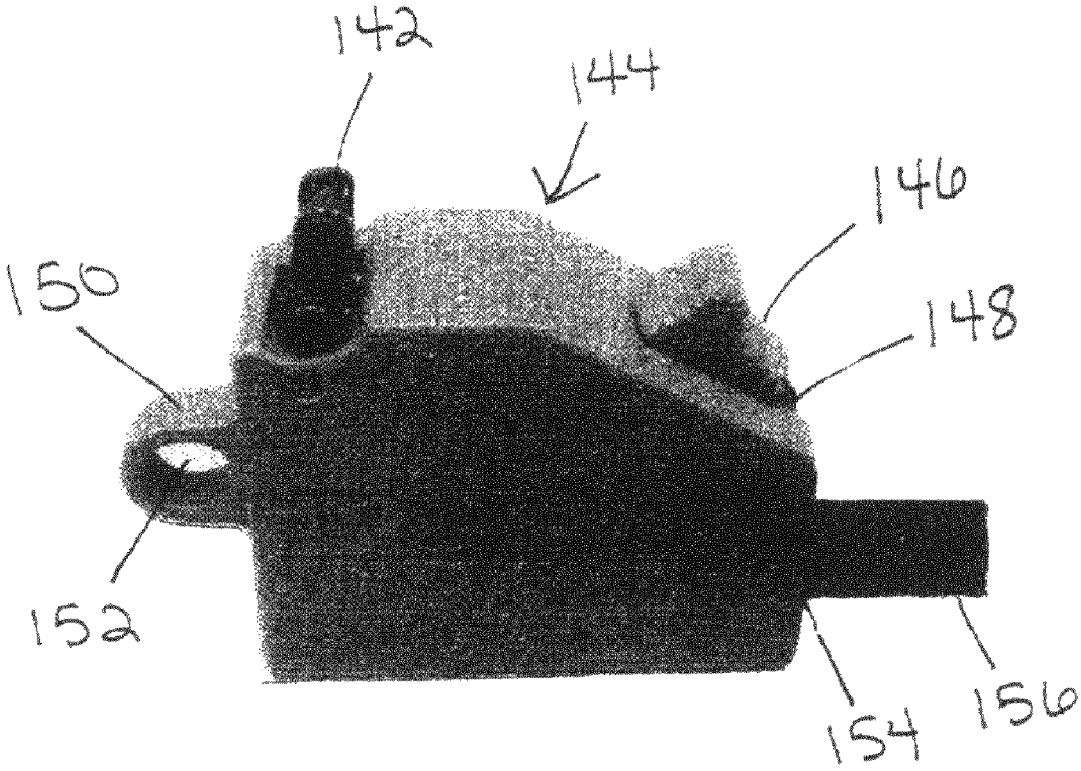
FIG. 9 is a perspective view showing an exemplary embodiment of the present invention.

Another embodiment of the present invention is shown in FIG. 9. The embodiment of the present invention shown in FIG. 9 has coupling 142 that functions similar to coupling 102 of FIG. 2. Coupling 142 attaches to the butt stud 32 of firearm 30. Strap tension aperture 154 found in housing 144 allows strap 156 to enter the housing 144. Again, similar to the earlier described embodiment of the present invention, lifting arm 150 allows the user to insert a rope or webbing into arm aperture 152 to lift the firearm with the barrel pointed to the ground to allow for safe lifting.

As shown in FIG. 9, this embodiment of the present invention features locking arm 146 to adjust the tension of strap 156. In FIG. 9, locking arm 146 is in a locked position. In the locked position, locking arm 146 prevents the strap tension from adjusting. This embodiment of the present invention utilizes locking arm 146 and locking arm aperture 148 to adjust the tension of the strap 156. The process of adjusting strap tension with locking arm 146 will be discussed below.

In one embodiment of the present invention, locking arm 146 contains grooves that assist a user in adjusting locking arm 146 between a locked and an unlocked position. Locking arm 146 can also be manufactured from different materials, such as plastic, rubber, or some other rigid material that allows a user to manipulate the positioning of locking arm 146. One design of locking arm 146 is shown in FIG. 9. The design of locking arm 146 can vary according to a user's needs.

Figure 10:
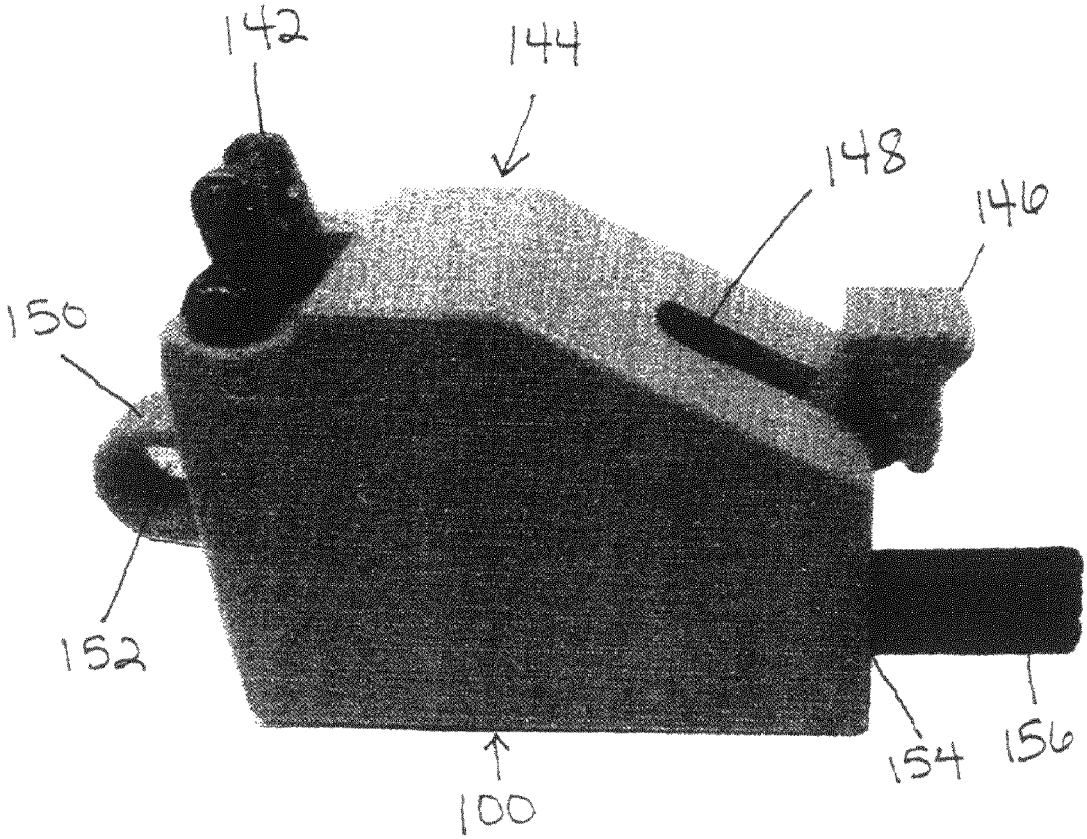
FIG. 10 is a perspective view thereof.

FIG. 10 shows an embodiment of the present invention in which locking arm 146 is adjusted to the unlocked position. Locking aperture 148 allows the user to adjust the locking arm 146 between the two different positions, the locked position and the unlocked position. In the unlocked position, a user can adjust the tension of the strap by adjusting the amount of strap 156 found within housing 144.

Figure 11:
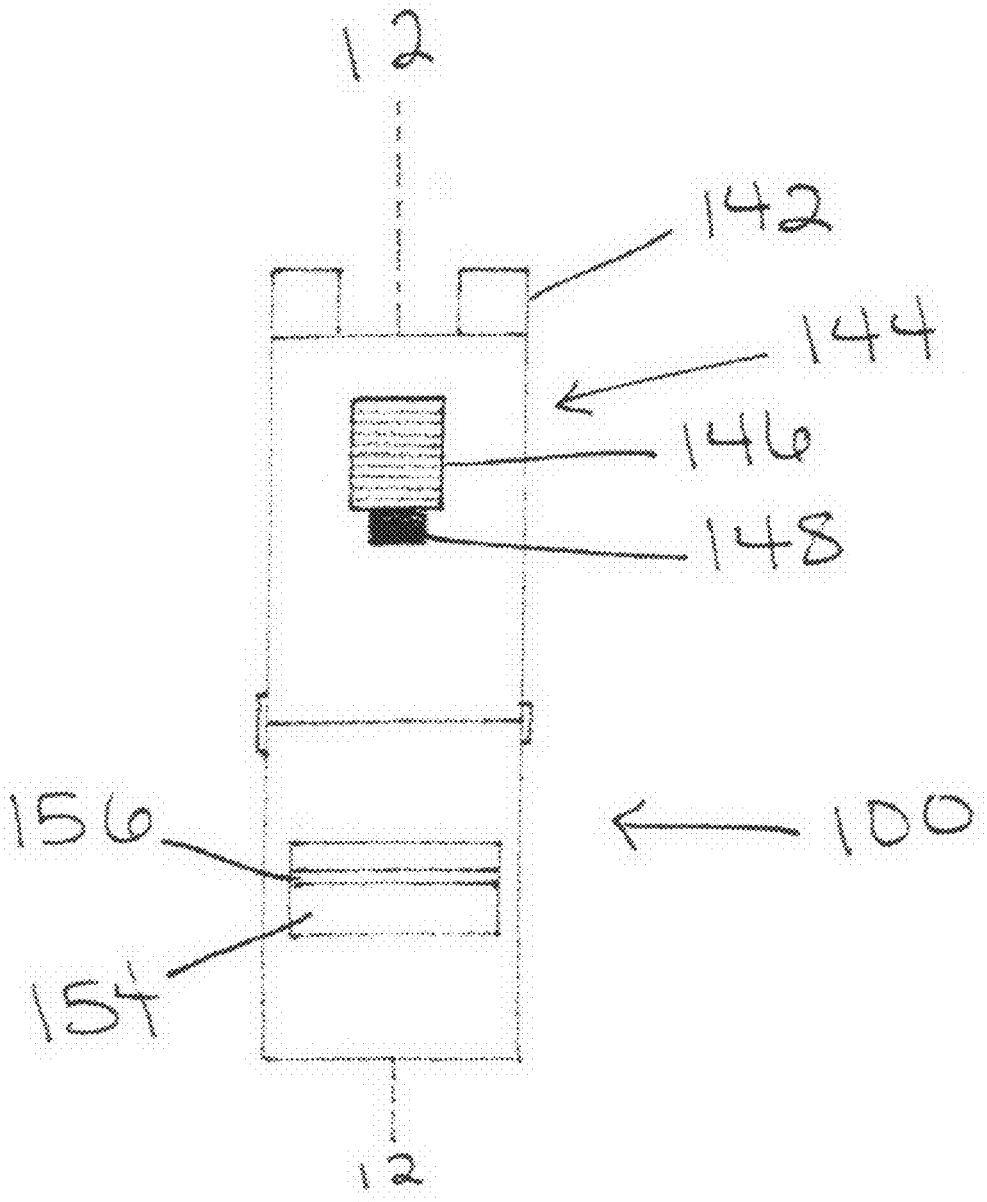
FIG. 11 is a front plan view thereof.

FIG. 11 shows a front plan view of one embodiment of the present invention. As seen in FIG. 11, locking arm aperture 148 allows movement of locking arm 146 in relation to the housing 144. By manipulating locking arm 146, a user can adjust strap tension by adjusting the amount of strap 156 within housing 144. As seen in FIG. 11, strap tension aperture 154 allows strap 156 to enter and exit housing 144 to adjust the strap tension.

Figure 12:
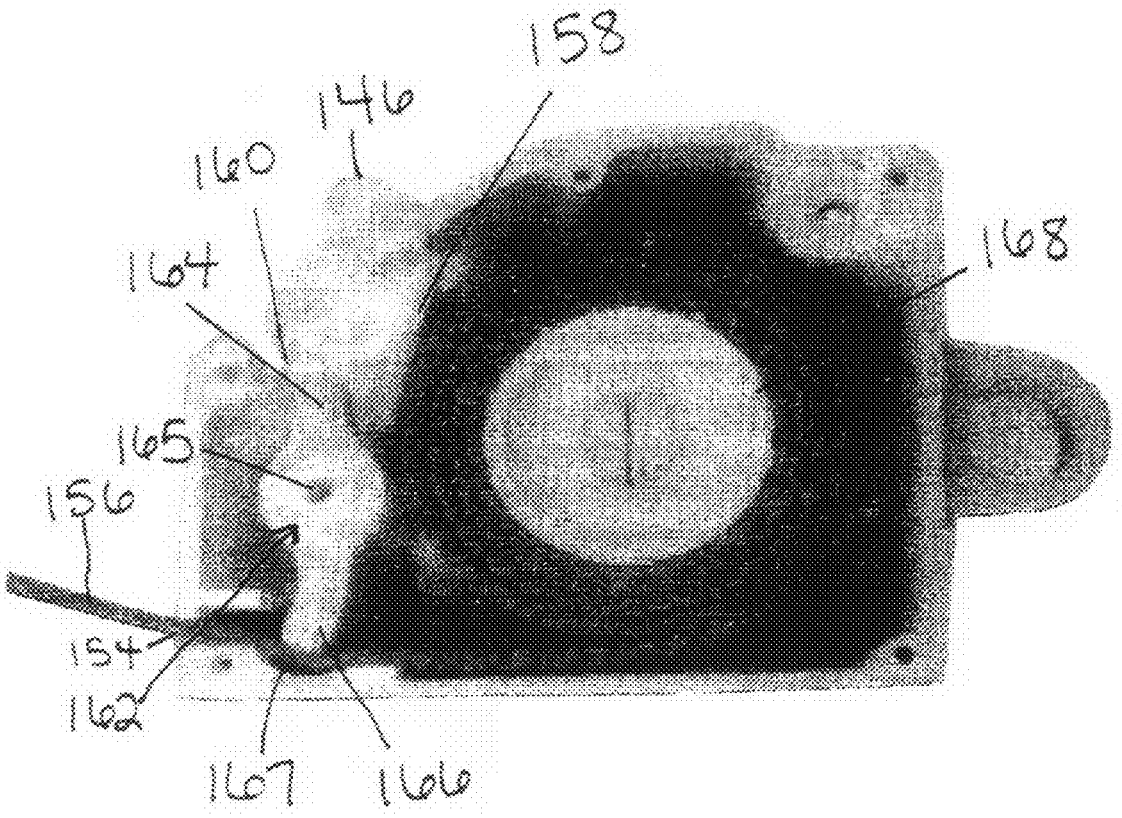
FIG. 12 is a sectional view taken along line 12-12 of FIG. 11 thereof, with portions omitted for clarity.
Figure 13:
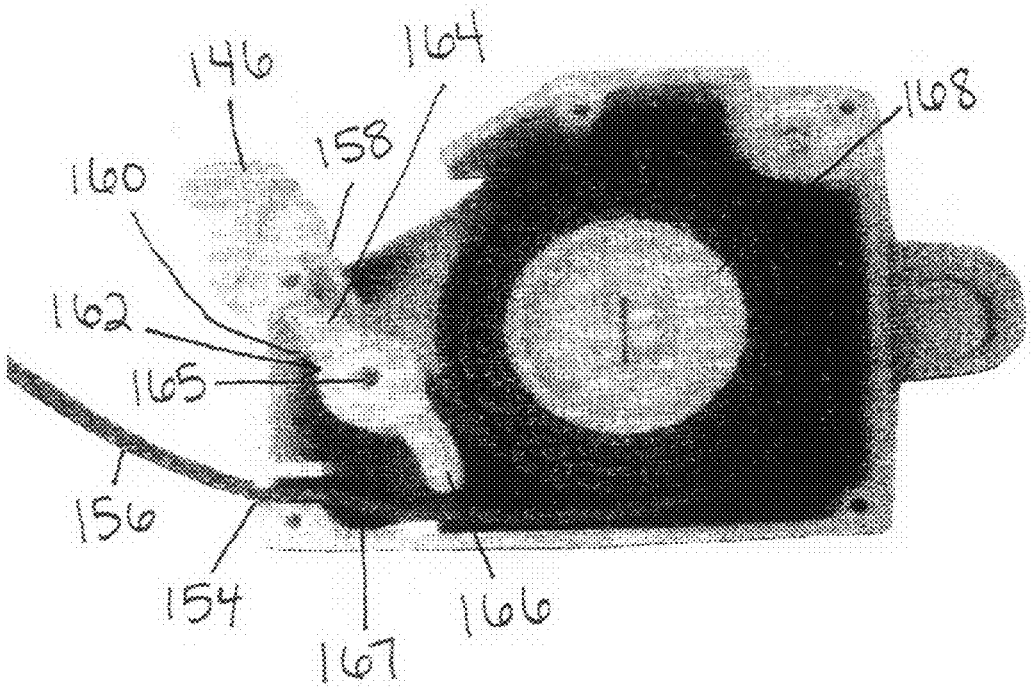
FIG. 13 is a sectional view taken along line 12-12 of FIG. 11 with the locking arm adjusted to a different position.

The process of adjusting the strap tension is shown in FIGS. 12 and 13. FIG. 12 shows an internal view of one embodiment of the present invention with the locking arm 146 in the locked position. Control lever 162 is attached inside housing 144 at control pivot 165 that allows control lever 162 to pivot within housing 144. As seen in FIG. 12, locking arm uses control fingers 158 and 160 to manipulate the position of control lever 162. Control fingers 158 and 160 contact control manipulation arm 164 to adjust the positioning of control lever 162 from a locked position to an unlocked position. As seen in FIG. 12, control finger 160 pushes control manipulation arm 164 such that control locking finger 166 pivots to the locked position. In the locked position, control locking finger 166 secures strap 156 within locking recess 167. Control locking finger 166 frictionally engages strap 156 within locking recess 167 such that strap 156 does not enter or exit housing 144. Therefore, additional strap 156 cannot be removed or added to spool 168 to adjust the strap tension.

As seen in FIG. 13, locking arm 146 has been adjusted to an unlocked position. Control finger 158 pushes control manipulation arm 164 such that control locking finger 166 pivots from locking recess 167 into the unlocked position. Strap 156 is no longer frictionally engaged by control lever 162 between control locking finger 166 and control recess 167. Strap 156 is now free to enter or exit housing 144 through strap tension aperture 154. As described above, spool 168 may be attached to a retraction device which may be spring loaded to assist winding of strap 156 around spool 168 to increase strap tension. To decrease strap tension, a user unwinds additional strap 156 from spool 168. As described above, a user must adjust the locking arm 146 to the unlocked position to adjust the strap tension. Once a user has obtained an ideal strap tension, the user adjusts the locking arm 146 to the locked position to prevent strap tension adjustment.

The spring loaded spool in the embodiments described above can be implemented, for example, with mechanisms known in the art. Examples of retractable systems are described in the following patents, all of which are incorporated herein by reference: U.S. Pat. Nos. 6,088,021; 6,065,080; 6,019,304; and 5,094,396.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A strap tension apparatus for attaching a strap to a firearm having a butt stud and a distal stock stud configured to connect the strap to the firearm, the strap having a first end attachable to the stock stud and a second end attached to a spool, said strap tension apparatus comprising:

a housing defining both a coupling attachment arm and a lifting arm, said housing configured to store at least a portion of the strap, said housing releases at least a portion of the strap for use outside of said housing, said housing having a strap tension aperture adapted to be a passageway from outside of said housing to said spool, said housing coupled to the butt stud of the firearm, said housing coupled externally to the firearm;

said lifting arm comprising an arm aperture, said arm aperture configured to receive a webbing to enable a user to lift the firearm in an oriented direction; and said spool rotatably secured inside of said housing.

2. The apparatus of claim 1 further comprising:

a retraction device operatively engaged with the spool, the retraction device configured to rotate said spool to bias the strap.

3. A strap tension apparatus for attaching a strap to a firearm having a butt stud and a distal stock stud configured to connect the strap to the firearm, the strap having a first end attachable to the stock stud and a second end attached to a spool, said strap tension apparatus comprising:

a housing coupled externally to the firearm, said housing configured to store at least a portion of the strap, said housing releases at least a portion of the strap for use outside of said housing, said housing having a strap tension aperture adapted to be a passageway from outside of said housing to said spool, said housing defining a coupling attachment arm;

said spool rotatably secured inside of said housing, the spool configured to selectively tension the strap, said spool configured to retract at least a portion of the strap within said housing;

the strap having a first end attachable to the stock stud and a second end attached to said spool wherein the first end of the strap directly attaches to the stock stud;

a coupling attached to said coupling attachment arm that secures said housing to the butt stud of the firearm; and a control lever configured to control the amount of said strap outside of said housing.

4. The apparatus of claim 3 further comprising:

a retraction device operatively engaged with the spool, the retraction device configured to rotate said spool to bias the strap.

* * * * *